US006651945B2

(12) United States Patent
Rivellino et al.

(10) Patent No.: US 6,651,945 B2
(45) Date of Patent: Nov. 25, 2003

(54) DEVICE FOR HANGING ARTICLES

(76) Inventors: Ernest Rivellino, 5591 NW. 3rd Ter., Boca Raton, FL (US) 33487; Michael E. Rivellino, 5591 NW. 3rd Ter., Boca Raton, FL (US) 33487

( * ) Notice: Subject to any disclaimer, the term of this patent is extended or adjusted under 35 U.S.C. 154(b) by 0 days.

(21) Appl. No.: 10/139,432

(22) Filed: May 6, 2002

(65) Prior Publication Data

US 2002/0125387 A1 Sep. 12, 2002

Related U.S. Application Data

(63) Continuation-in-part of application No. 09/934,425, filed on Aug. 21, 2001.

(60) Provisional application No. 60/244,174, filed on Oct. 31, 2000.

(51) Int. Cl.[7] ..... A47G 1/17

(52) U.S. Cl. ..... 248/206.5; 248/467; 248/489; 248/683

(58) Field of Search ..... 248/683, 206.5, 248/267, 470, 304, 467, 489, 475.1, 300, 301

(56) References Cited

U.S. PATENT DOCUMENTS 2,049,716 A * 8/1936 Owen ..... 248/549
2,679,998 A * 6/1954 Keller ..... 248/205.3
3,312,442 A * 4/1967 Moeller ..... 248/217
3,433,449 A * 3/1969 Musante ..... 248/297
4,544,067 A * 10/1985 Miller ..... 211/70.6
5,110,077 A * 5/1992 Mossini ..... 248/205.3
5,269,083 A * 12/1993 Vampatella ..... 40/124.1
5,417,397 A * 5/1995 Harnett ..... 248/309.4
5,588,629 A * 12/1996 Barnes ..... 248/475.1
5,642,871 A * 7/1997 Repert ..... 248/686
6,176,033 B1 * 1/2001 Latwesen ..... 42/4.5
6,216,888 B1 * 4/2001 Chien ..... 211/87.01
6,241,210 B1 * 6/2001 Brindisi ..... 248/476

* cited by examiner

*Primary Examiner*—Ramon O. Ramirez
*Assistant Examiner*—Amy J. Sterling
(74) *Attorney, Agent, or Firm*—Akerman Senterfitt

(57) ABSTRACT

A device for hanging an article with a portion having magnetic susceptibility such as a metallic hanging wire or loop. The device includes a base portion for attaching the device to a structure. The base portion includes a wall-engaging portion and an article guiding portion. The device also includes an engagement structure for engaging the article, the engagement structure attached to the base portion. At least a portion of the device includes magnetic material to attract the portion of the article having magnetic susceptibility. The article guiding portion guides the article to the engagement structure so as to facilitate the engaging of the article to the engagement structure.

15 Claims, 7 Drawing Sheets

DEVICE FOR HANGING ARTICLES

CROSS-REFERENCE TO RELATED APPLICATIONS

This application is a continuation-in-part of U.S. patent application Ser. No. 09/934,425 filed Aug. 21, 2001, which claims priority from U.S. patent application Ser. No. 60/244,174 filed on Oct. 31, 2000.

STATEMENT REGARDING FEDERALLY SPONSORED RESEARCH OR DEVELOPMENT (not applicable)

BACKGROUND OF THE INVENTION

1. Technical Field

This invention relates generally to devices for supporting objects and, more particularly, to hanging devices for supporting decorative articles.

2. Description of Related Art

Many different types of devices have been used for hanging articles such as decorative objects. As an example, many hanging devices include a base which can be secured to a wall and a hook portion attached to the base. The hook portion can be used to support a number of decorative objects such as paintings, photographs, mirrors or other works of art. These decorative objects typically include a hanging element such as a wire that is attached to opposite ends of the object and stretches across the back of the object or a hanging loop attached to the back of the object. To support the decorative object, the hanging element is placed above the hook portion and is lowered until the hook portion engages or catches the hanging element.

Significantly, however, this process of engaging the hook portion with the hanging element can be difficult and time consuming. For example, in most cases, the hanging element does not rise above the top of the decorative object, and the person attempting to hang the object is unable to see the hook portion or the hanging element. Moreover, many of the hanging elements are bendable and movable, further complicating the attempt to secure the hanging element to the hook portion. Thus, what is needed is a hanging device which simplifies the process of hanging objects without presenting significant increases in complexity or costs.

SUMMARY OF THE INVENTION

The present invention concerns a device for hanging an article with a portion having magnetic susceptibility such as a metallic hanging wire or loop. The device includes a base portion for attaching the device to a structure. The base portion includes a wall-engaging portion and an article guiding portion. The device also includes an engagement structure for engaging the article, in which the engagement structure is attached to the base portion. At least a portion of the device includes magnetic material to attract the portion of the article having magnetic susceptibility. The article guiding portion guides the article to the engagement structure so as to facilitate the engaging of the article to the engagement structure.

In one aspect, the wall-engaging portion and the article guiding portion can each contain at least one aperture for receiving at least one fastener. The apertures of the wall-engaging portion and the article guiding portion may be positioned in such a way as to guide the receipt of the fastener in accordance with a range from approximately a 20° angle to approximately a 70° angle. The apertures of the wall-engaging portion and the article guiding portion may guide the receipt of the fastener at an angle of approximately 45°. The aperture in the article guiding portion may be countersunk.

According to one arrangement, the magnetic material may be provided in a magnetic insert, the device including an opening for receiving the magnetic insert. The magnetic insert may be inserted into the device between the wall engaging portion and the article guiding portion.

According to another arrangement, the device may be formed entirely of a magnetic material. The article guiding portion and the engagement structure may define a substantially S-shaped curve for receiving the article.

According to yet another arrangement, the device may include side portions, and the magnetic insert may be located between the side portions. The device may include a top portion, and the wall-engaging portion and the top portion may each contain at least one aperture for receiving at least one fastener.

In yet another arrangement, the device may include an aperture to receive an additional fastener. Another arrangement includes a spike portion that may be used to affix the device to a wall in addition to the at least one fastener.

It will be noted that, in some embodiments, the device may be self-contained, so that no portion of the device is located on the article to be hung.

DETAILED DESCRIPTION OF THE PREFERRED EMBODIMENTS

Figure 1:
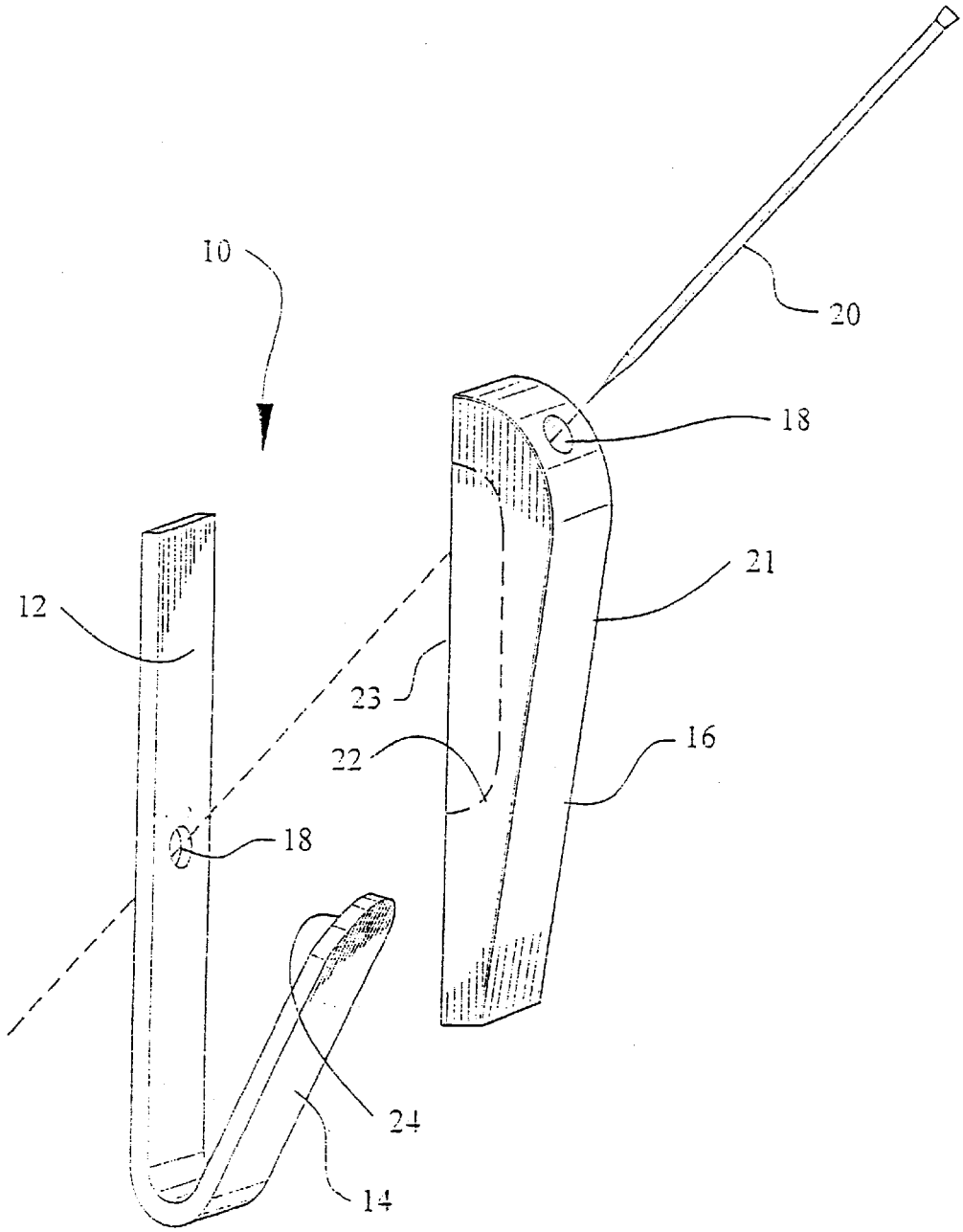
FIG. 1 is a perspective view of a device for hanging articles in accordance with the inventive arrangements.

FIG. 1 illustrates a device 10 for hanging an article (not shown) in which a portion of the article such as a metallic hanging wire or loop has magnetic susceptibility. The device 10 can include a base member 12 and a magnetic member 16. The base member 12 can be used to attach the device 10 to a structure such as a wall. Additionally, the base member 12 can include an engagement structure 14, which can be used to engage the article. The magnetic member 16 can be coupled to the base member 12, and at least a portion of the magnetic member 16 can comprise magnetic material (not shown). In one arrangement, the magnetic member 16 can contain a slot (not shown) for receiving the base member 12. The magnetic material can be positioned on the magnetic member 16 to attract the portion of the article having magnetic susceptibility so as to facilitate the engaging of the article to the engagement structure 14.

In one arrangement, the base member 12 and the magnetic member 16 can each include at least one aperture 18 for receiving one or more fasteners 20. The fastener 20 which may, for example, be a nail, can be used for the purpose of attaching the device 10 to the structure, e.g., a wall. It should be noted that any suitable fastener 20 can be used. In addition, the apertures 18 can be positioned in such a way as to guide the receipt of the fastener 20 in accordance with a range from approximately a 20° angle to approximately a 70° angle; however, it is understood that the invention is not limited to this particular arrangement, as the apertures 18 can be positioned in any other suitable location.

Referring to the magnetic member 16, the magnetic member 16 can be entirely or substantially composed of magnetic material. In addition, magnetic material can be positioned at any suitable location on the magnetic member 16. For example, the magnetic material can be located directly on an outer surface 21 of the magnetic member 16, or can be located in the interior of the magnetic member 16. To enable the magnetic material to be placed in the interior of the magnetic member 16, the magnetic member 16 can include a cavity 22 represented by the dashed lines for receiving the magnetic material. The cavity 22 can also include an opening 23 thereby permitting a user to place a suitable amount of magnetic material in the cavity 22. Although FIG. 1 illustrates the opening 23 as being located on the side of the magnetic member 16 facing the base member 12, the invention is not so limited. In fact, the opening 23 can be at any other suitable location on the magnetic member 16. Moreover, the cavity 22 need not contain an opening 23, as the magnetic material can be placed in the cavity 22 during the manufacturing process. No matter where the magnetic material is placed (such as on an outside surface or in the interior of the magnetic member 16), the magnetic material in some arrangements can be positioned such that it is above the highest point of the engagement structure 14. Alternatively, the magnetic material can be placed on an inside surface of the engagement structure 14. In addition, it should be noted that the magnetic material can be any material capable of attracting the portion of the article having magnetic susceptibility.

The engagement structure 14 can be any type of structure capable of supporting the article. For example, the engagement structure 14 can be a hook, as shown in FIG. 1. In one arrangement, at least a portion of the engagement structure 14 can extend upwardly away from the base member 12 or upwardly in a direction substantially parallel to the base member 12 in order to prevent the article from slipping off the engagement structure 14 once the engagement structure 14 has received the article. In another arrangement, the engagement structure 14 can include an interior surface 24. In this particular arrangement, the magnetic material can also be positioned on the interior surface 24 of the engagement structure 14 to ensure proper attraction of the magnetically susceptible portion of the article.

Figure 2A:
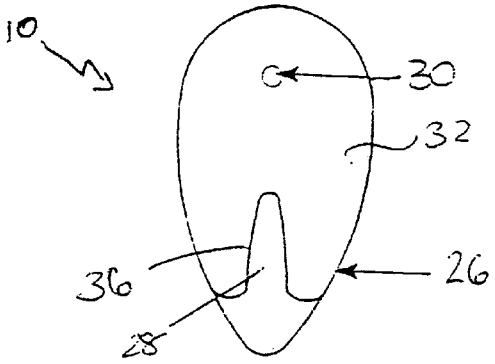
FIGS. 2*a* and 2*b* are front and side views of a device for hanging articles in accordance with the inventive arrangements.
Figure 2B:
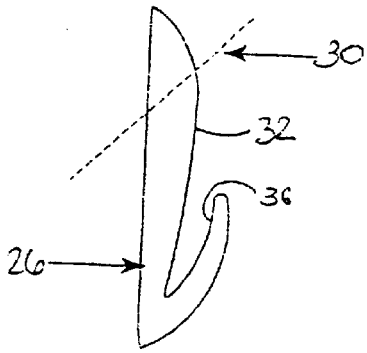

FIGS. 2*a* and 2B shows an alternative arrangement of the device 10 of FIG. 1. As shown, a base member 26 can be a single molded piece containing an engagement structure 28. In addition, magnetic material can be positioned on the base member 26 for attracting the portion of the article having magnetic susceptibility so as to facilitate the engaging of the article to the engagement structure 28. The base member 26 can also have at least one aperture 30 for receiving one or more fasteners (not pictured). Similar to the device 10 of FIG. 1, the aperture 30 can be positioned in such a way as to guide the receipt of the fastener in accordance with a range from approximately a 20° angle to approximately a 70° angle. It should be noted, however, that the invention is not limited in this regard, as the aperture 30 can be positioned to guide the receipt of the fastener in accordance with any other suitable angle. An outer surface 32 of the device is curved to guide an article into the engagement structure 28, to facilitate easy placement of the article on the device.

Figure 3A:
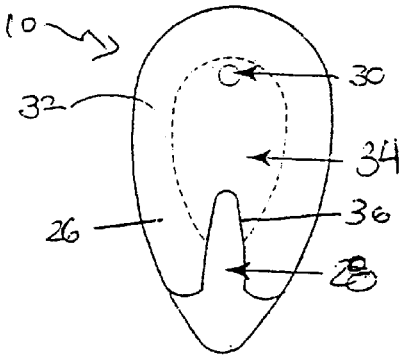
FIGS. 3*a* and 3*b* are front and side views of a device for hanging articles with a cavity for receiving magnetic material.
Figure 3B:
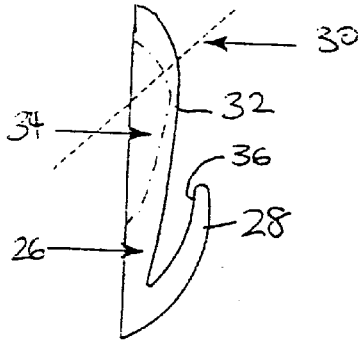

Continuing with FIGS. 2*a* and 2*b*, the magnetic material can be positioned at any suitable location on the base member 26. For example, the magnetic material can be located directly on the outer surface 32 of the base member 26 or can be located in the interior of the base member 26. Referring to FIGS. 3*a* and 3*b*, in this particular arrangement, the base member 26 can contain a cavity 34 represented by the dashed lines and an opening (not shown) for receiving the magnetic material should it be desired to store the magnetic material within the interior of the base member 26. Further, the opening can be located at any suitable location on the base member 26, or alternatively, the magnetic material can be placed inside the base member 26 during the manufacturing process thereby eliminating the need for the opening. Further, in one embodiment, the magnetic material can be located on an area of the base member 26 such that the magnetic material is above the highest point of the engagement structure 28. Similar to the device 10 of FIG. 1, the magnetic material can be any material capable of attracting the portion of the article having magnetic susceptibility. The outer surface 32 of the device can be curved to guide an article into the engagement structure 28, to facilitate easy placement of the article on the device.

The engagement structure 28 can be any type of structure capable of supporting the article such as a hook. At least a portion of the engagement structure 28 can extend upwardly away from the base member 26 or upwardly in a direction substantially parallel to the base member 26 in order to prevent the article from slipping off the engagement structure 28 once the engagement structure 28 has received the article. As shown in FIGS. 2*a*, 2*b*, 3*a*, and 3*b*, the engagement structure 28 can also include an interior surface 36. In this particular arrangement, if the magnetic material is positioned on other portions of the base member 26, then magnetic material can also be positioned on the interior surface 36 of the engagement structure 28 to ensure proper attraction of the magnetically susceptible portion of the article. Alternatively, the magnetic material can be placed on the interior surface 36 exclusive of any other portion of the base member 26.

Figure 4:
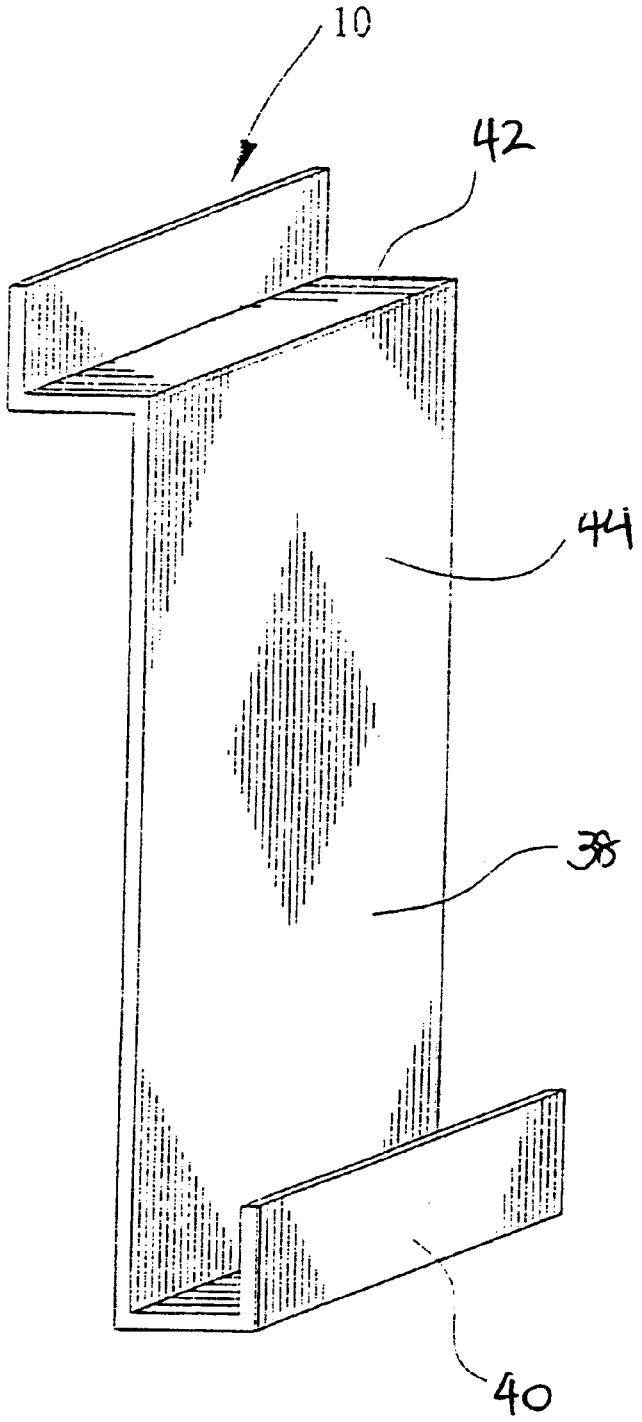
FIG. 4 is a perspective view of a device for hanging articles in accordance with the an inventive arrangements.

FIG. 4 shows another embodiment of the present invention. As shown, the device 10 can include the base member 38, which can include the engagement structure 40 and an adapting structure 42. The adapting structure 42 can be used for purposes of engaging structure designed to support decorative objects such as a slat board or other related structures. Similar to the embodiments discussed above, the magnetic material can be positioned at any suitable location on the base member 38 such as the outer surface 44 of the base member 38 or the interior of the base member 38. In addition, the magnetic material can be positioned such that it is above the highest point of the engagement structure 40 and can also be positioned on the engagement structure 40 in addition to or exclusive of any other portion of the base member 38.

Figure 5:
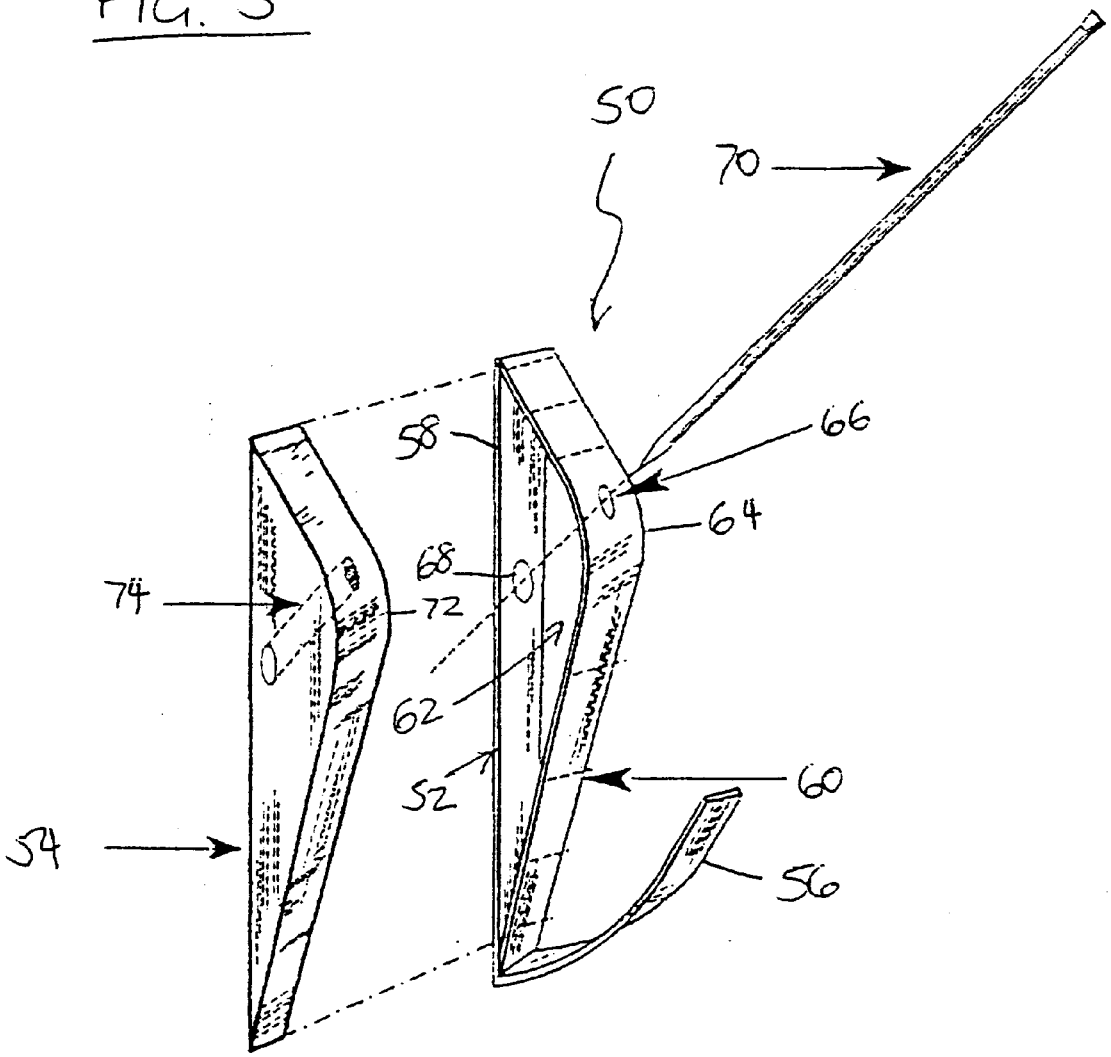
FIG. 5 is a perspective view of a device for hanging articles in accordance with the inventive arrangements.

FIG. 5 shows an alternative arrangement of a device according to the invention. The device 50 can include a base member 52 and a magnetic member 54. The base member 52 can be used to attach the device 50 to a structure such as a wall. The base member 52 can include an engagement structure 56, which may be an upwardly curving hook, a wall engaging portion 58 which can be substantially planar, and may have an upper portion 60 which can be bent so as to form an opening 62 in front of the wall engaging portion 58. The opening 62 may define an apex 64 of the opening 62 located at a part of the curved upper portion 60 which is furthest from the wall engaging portion 58. The upper portion 60 and the wall engaging portion 58 can have aligned apertures 66 and 68 defining an angle therebetween of approximately 45° to allow a fastener 70 such as a nail to pass through the apertures 66 and 68 and into a wall. It will be appreciated that the apertures may be at any suitable angle. The aperture 66 may be countersunk to prevent a head of the fastener 70 from protruding above the surface of the upper portion 60. The aperture 66 can be positioned slightly above the apex 64 on the upper portion 60. The magnetic member 54 can include a rounded apex 72, and can include an aperture 74 positioned slightly above the apex 72. The aperture 74 may be inclined at approximately 45° to vertical, although any suitable angle may be used. The magnetic member 54 may be inserted into opening 62 of the base member 52. The aperture 74 of the magnetic member 54 can align with the apertures 66 and 68 of the base member 52 to allow the fastener 70 to pass fully through the device 50. The magnetic member 54 can attract a portion of the article to be hung having magnetic susceptibility, such as a hanging wire. The curved shape of the upper portion 60 and the apex 64 can guide the hanging wire into the hook 56 to allow for ease in positioning the article and engaging the article with the device 50.

Figure 6:
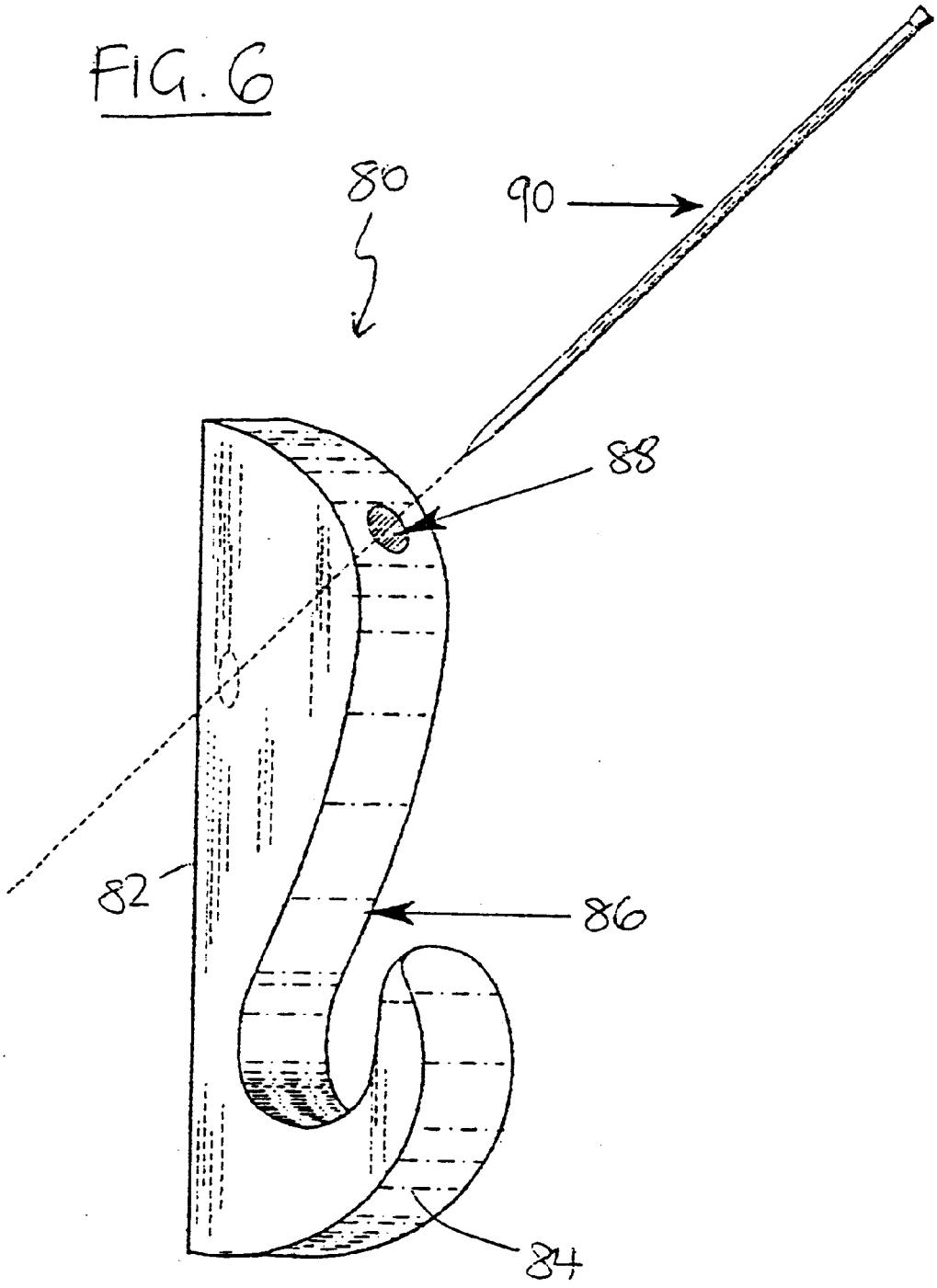
FIG. 6 is a perspective view of a device for hanging articles in accordance with the inventive arrangements.
Figure 7:
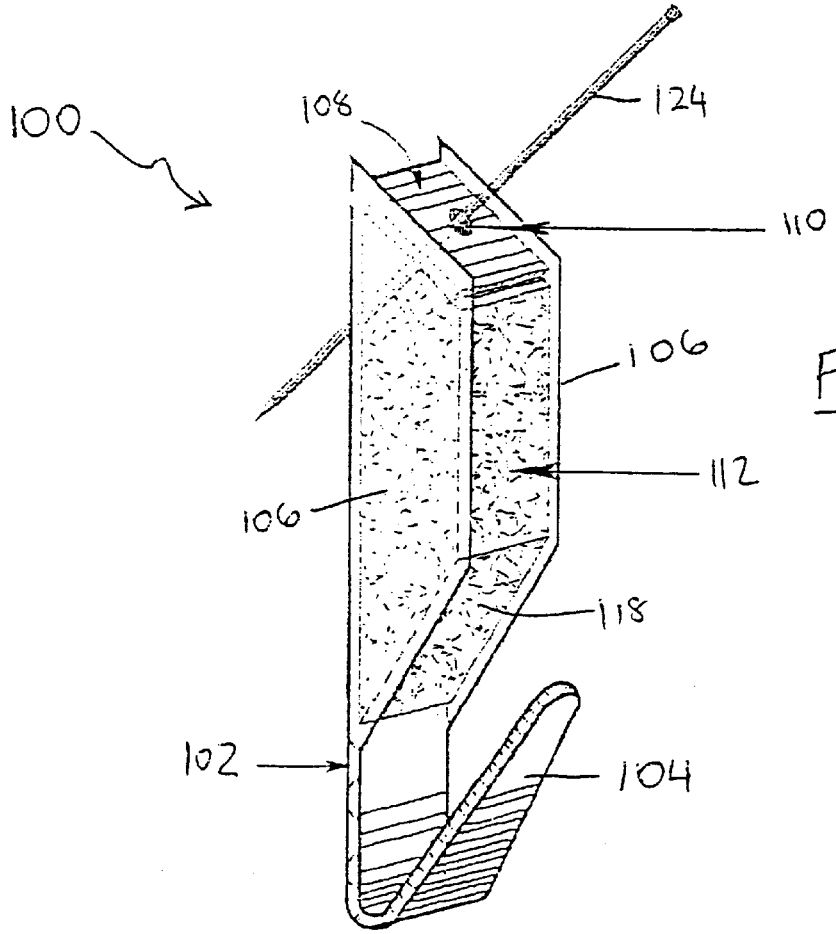
FIG. 7 is a perspective view of a device for hanging articles in accordance with the inventive arrangements.

FIG. 6 shows another alternative arrangement of a device according to the invention. The device 80 can be formed of a single unit of magnetic material and can include a flat wall engaging portion 82. A bottom surface 84 of the device may curve upwardly to form the bottom of a hook. An upper surface 86 of the device curves in an S-shape (when looking at the article from one side, the other side as illustrated in FIG. 7 is in the shape of a reverse S). A hook for receiving articles is formed in the lower curve of the S-shaped surface 86, defining an article engagement structure. An aperture 88 can extend through the device at an angle of approximately 45°, and can be countersunk to enable a fastener 90 such as a nail to be used to fasten the device to a wall, the countersunk aperture 88 allowing a head of the fastener to be flush with the surface of the device. The magnetic material of the device 80 can attract a portion of an article to be hung, and the curve of the S-shaped surface 86 can guide the portion of the article into the hook formed in the lower curve of the surface 86. The countersunk aperture 88 can ensure that the fastener 90 does not catch the article as it is guided along surface 86 into the hook portion.

Figure 8:
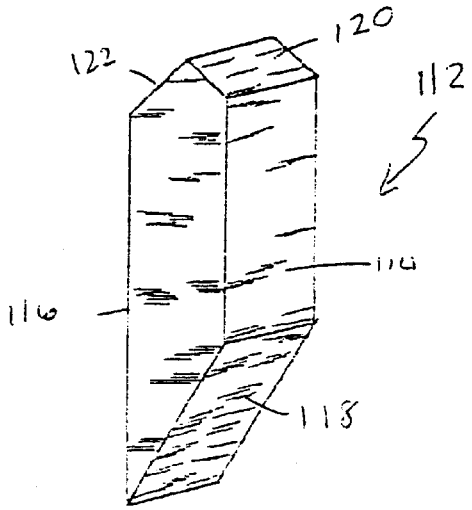
FIG. 8 is a perspective view of a magnetic insert for use in a device for hanging articles in accordance with the inventive arrangements.

FIGS. 7 and 8 show yet another alternative arrangement of a device according to the invention. The device 100 is formed from sheet metal, and includes a wall engaging portion 102, an engagement portion in the form of an upwardly directed hook portion 104, two side pieces 106, and a top piece 108. The side pieces 106 are folded at about 90° to the wall engaging portion 102. The top piece 108 is folded to an acute angle of about 45° with the wall engaging portion 102. The top piece may have an aperture 110 therethrough. A magnetic insert 112 formed of a magnetic material may be located inbetween the side and top pieces 106 and 108. The magnetic insert 112 and side pieces 106 may be shaped to facilitate attachment of an object to the device.

As can be seen particularly in FIG. 8, the magnetic insert 112 may have parallel front and back surfaces 114 and 116. A lower surface 118 may be arranged at an angle of approximately 20–40° to the back surface 116 and may extend to the front surface 114, to allow a portion of the article to be hung, such as a hanging wire, to be guided into the hook portion 104. An upper part of the magnetic insert 112 may have a first upper surface 120 angled at approximately 45° to the front surface 114 of the insert in order to align with the top piece 108. A second upper surface 22 may be angled at approximately 45° to the back surface 116 of the insert so that a fastener 124 may be inserted through the aperture 110 in the top piece 108 at an angle of approximately 45°, and may pass directly above the surface 122 so that an aperture does not need to be made in the magnetic insert. The upper surfaces 120 and 122 meet in an apex located just below the aperture 110 of the top piece 108. The fastener 124 may also pass through an aperture (not shown) in the wall engaging portion 102. The magnetic insert may be fastened into the device by adhesive, or by any other suitable means. Additional mounting holes (not shown) or a spike portion (not shown), as described in the following paragraphs with respect to FIGS. 9 and 10 may also be included for mounting the device onto a wall.

Figure 9:
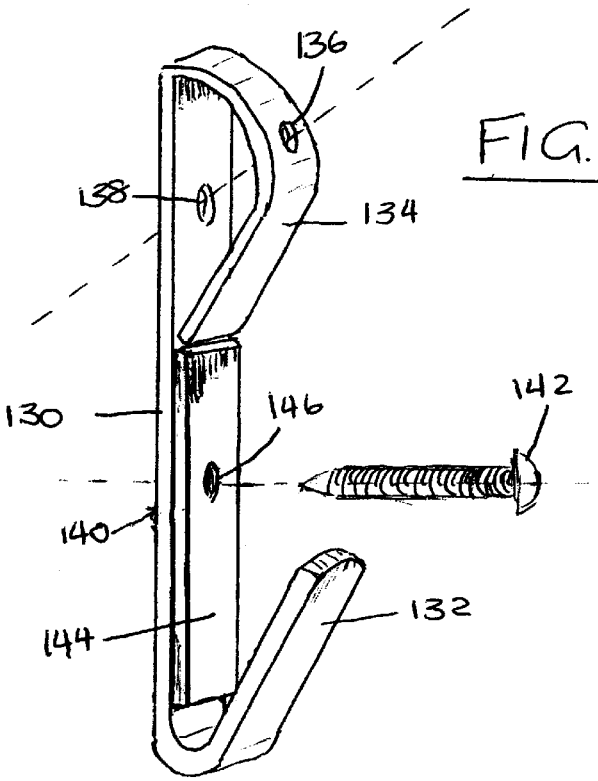
FIG. 9 is a perspective view of a device for hanging articles in accordance with the inventive arrangements.

FIG. 9 shows yet another embodiment of the invention, having a wall engaging portion 130, engagement structure 132 in the form of an upwardly directed hook portion, and an article guiding portion 134. Aligned apertures 136, 138 allow a fastener (not shown) to be used to attach the device to a wall or other supporting surface. One or more additional apertures 140 may be provided in the wall engaging portion, to enable an additional fastener 142 to be used to fasten the device to a wall, for example into a wall stud. The additional fastener 142 may be of use in hanging heavy items, as they can be used to anchor the device to the wall more securely than if just one fastener was used. The additional fastener 142, if used, may be a screw, wall anchor, nail or any other suitable fastener. A magnetic member 144 may be attachable to the device, such as by glueing, and may have an aperture 146 to enable the additional fastener 142 to be inserted therethrough, for example with a wall anchor or nail. Alternatively, the magnetic member may be removable from the device.

Figure 10:
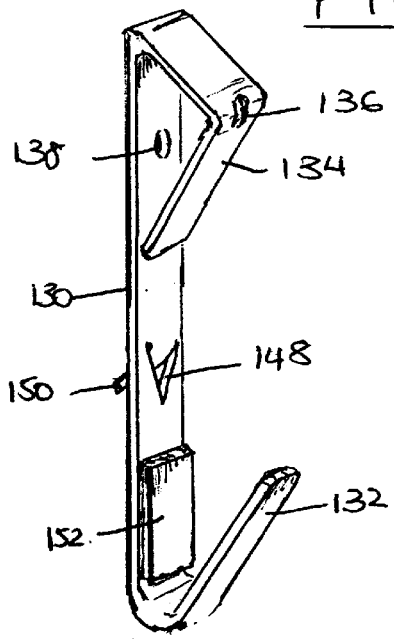
FIG. 10 is a perspective view of a device for hanging articles in accordance with the inventive arrangements.

In another embodiment of the invention shown in FIG. 10, where like features to the embodiment of FIG. 9 have like reference numerals. A spike portion may be included that may be pressed into engagement with the wall for initial securement of the device to a wall or so that additional support may be given to the device. The spike portion may be, for example, a V-shaped cut 148 made in the wall engaging portion so that a V-shaped spike portion in the form of a tab 150 may be formed and bent outwardly. The V-shaped tab 150 may be pressed into engagement with the wall so that additional support may be given to the device, and also so that the device may be initially secured onto the wall using the V-shaped tab 150 alone and then firmly secured to the wall with the fastener. It will be appreciated that the spike portion may have any suitable shape and arrangement. A magnetic member 152 may be attachable to the wall engaging portion 130, for example by glueing. In some arrangements, the magnetic member 152 may be simply attached to the wall engaging portion 130 by magnetic force so that it may easily be removable.

It will be appreciated that any suitable shape of device for hanging articles may be employed, with any form of magnetic material, and that the invention is not limited in this regard. Further, it should be understood that features described with reference to one embodiment are not to be construed as being limited to use with the described embodiment, but may be employed in other embodiments. It should be further understood that the examples and embodiments described herein are for illustrative purposes only and that various modifications or changes in light thereof will be obvious to persons skilled in the art and are to be included within the spirit and purview of this application. Moreover, the invention can take other specific forms without departing from the spirit or essential attributes thereof.

What is claimed is:

1. A device for hanging decorative article with a hanging wire or loop portion having magnetic susceptibility, comprising:

a base portion for attaching said device to a structure, said base portion comprising a wall-engaging portion and an article guiding portion including at least one article guiding surface; and an upwardly directed hook for engaging the article hanging wire or loop, wherein said hook is attached to said base portion, wherein at least a portion of said device comprises magnetic material to attract the portion of the article having magnetic susceptibility to the article guiding surface; and wherein said article guiding surface guides the article hanging wire or loop into the hook so as to facilitate the engaging of the article to said hook.

2. The device according to claim 1, wherein said wall-engaging portion and said article guiding portion each contain at least one aperture for receiving at least one fastener.

3. The device according to claim 2, wherein the apertures of said wall-engaging portion and said article guiding portion are positioned in such a way as to guide the receipt of said fastener in accordance with a range from approximately a 20° angle to approximately a 70° angle.

4. The device according to claim 3, wherein the apertures of said wall-engaging portion and said article guiding portion guide the receipt of said fastener at an angle of approximately 45°.

5. The device according to claim 2, wherein said aperture in said article guiding portion is countersunk.

6. The device according to claim 2, wherein the wall engaging portion contains at least two apertures.

7. The device according to claim 1, wherein said magnetic material is provided in a magnetic insert, said device including an opening for receiving said magnetic insert.

8. The device according to claim 7, wherein said magnetic insert is inserted into said device between said wall engaging portion and said article guiding portion.

9. The device according to claim 1, wherein said device is formed entirely of a magnetic material.

10. The device according to claim 1, wherein said magnetic material is provided in a removable magnetic member.

11. The device according to claim 1, wherein said article guiding surface and said hook define a substantially S-shaped curve for receiving the article.

12. The device according to claim 1, comprising two of said article guiding surfaces, wherein said article guiding surfaces comprises sides to said device, said magnetic material being located between said sides of said device.

13. The device according to claim 1, wherein said device includes a top portion, and wherein said wall-engaging portion and said top portion each contain at least one aperture for receiving at least one fastener.

14. The device according to claim 1, wherein said wall-engaging portion includes a spike portion for engaging a wall.

15. The device according to claim 12, wherein said sides of said device project above said magnetic material such that the hanging wire or loop is prevented by said sides from coming into complete contact with said magnetic material.

* * * * *